US008831464B2

(12) United States Patent
Mitourida

(10) Patent No.: US 8,831,464 B2
(45) Date of Patent: Sep. 9, 2014

(54) IMAGE FORMING APPARATUS

(75) Inventor: Shinya Mitourida, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 113 days.

(21) Appl. No.: 13/569,479

(22) Filed: Aug. 8, 2012

(65) Prior Publication Data

US 2013/0251385 A1 Sep. 26, 2013

(30) Foreign Application Priority Data

Mar. 21, 2012 (JP) ..... 2012-063725

(51) Int. Cl.
*G03G 21/20* (2006.01)

(52) U.S. Cl.
USPC ..... 399/92; 399/44

(58) Field of Classification Search
CPC ..... G03G 21/20; G03G 21/206; G03G 2221/1645
USPC ..... 399/44, 92
See application file for complete search history.

(56) References Cited

U.S. PATENT DOCUMENTS

| | | | | |
|---|---|---|---|---|
| 5,166,727 | A * | 11/1992 | Miyamoto et al. | 399/92 |
| 2005/0111872 | A1 * | 5/2005 | Peffer et al. | 399/92 |
| 2009/0208237 | A1 | 8/2009 | Yasuda | |
| 2011/0176275 | A1 * | 7/2011 | Sato | 361/695 |

FOREIGN PATENT DOCUMENTS

| | | | |
|---|---|---|---|
| JP | 2000250381 | A * | 9/2000 |
| JP | 2009-180917 | A | 8/2009 |
| JP | 2009-271237 | A | 11/2009 |

* cited by examiner

*Primary Examiner* — Ryan Walsh
(74) *Attorney, Agent, or Firm* — Sughrue Mion, PLLC

(57) ABSTRACT

An image forming apparatus includes a housing, a detection unit provided in the housing to detect temperature or humidity, an image forming section provided in the housing and including a detected portion to be detected by the detection unit, a first air inlet provided in the housing, a suction unit that sucks air outside of the housing through the first air inlet, a substantially cylindrical duct provided at a position influenced by temperature or humidity of the detected portion and including an entrance from which air flows in and an exit from which air flows out, the duct allowing the air sucked by the suction unit to pass therethrough, and an opening provided in the housing. The detection unit is provided at a position on a path of air flowing into the housing through the opening and on a path of the air that has passed through the duct.

14 Claims, 9 Drawing Sheets

| TEMPERATURE OF DEVELOPING UNIT | MEASURED TEMPERATURE |
|---|---|
| 53°C | 33°C |
| 54°C | 34°C |
| 55°C | 35°C |
| • • • | • • • |

T

IMAGE FORMING APPARATUS

CROSS-REFERENCE TO RELATED APPLICATIONS

This application is based on and claims priority under 35 USC 119 from Japanese Patent Application No. 2012-063725 filed Mar. 21, 2012.

BACKGROUND

Technical Field

The present invention relates to an image forming apparatus.

SUMMARY

According to an aspect of the invention, there is provided an image forming apparatus including: a housing; a detection unit provided in the housing to detect temperature or humidity; an image forming section provided in the housing to form an image and including a detected portion to be detected by the detection unit; a first air inlet provided in the housing; a suction unit that sucks air outside of the housing through the first air inlet; a substantially cylindrical duct provided at a position influenced by temperature or humidity of the detected portion and including an entrance from which air flows in and an exit from which air flows out, the duct allowing the air sucked by the suction unit to pass therethrough; and an opening provided in the housing. The detection unit is provided at a position on a path of air flowing into the housing through the opening and on a path of the air that has passed through the duct.

BRIEF DESCRIPTION OF THE DRAWINGS

An exemplary embodiment of the present invention will be described in detail based on the following figures, wherein.

DETAILED DESCRIPTION

1. Configuration

Figure 1:
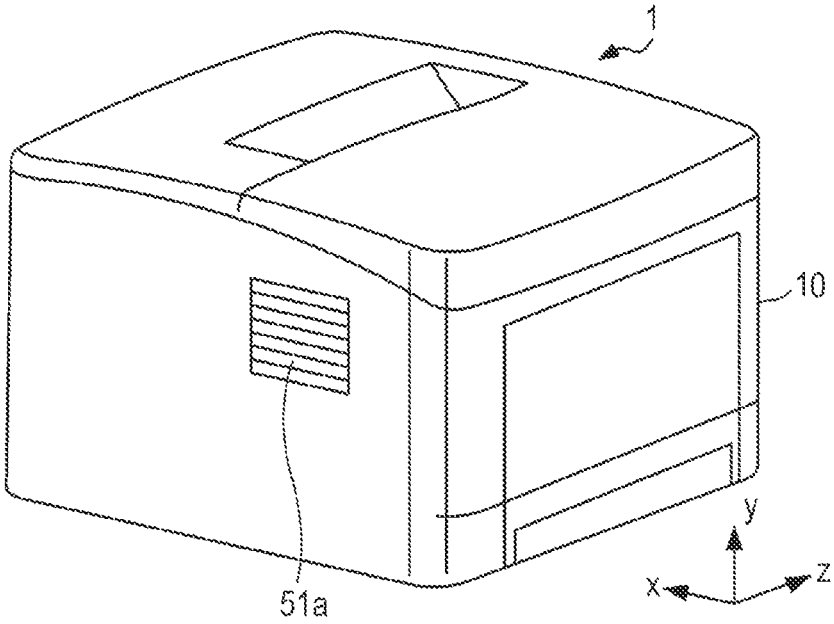
FIG. 1 is a perspective view of an image forming apparatus according to an exemplary embodiment.
Figure 2:
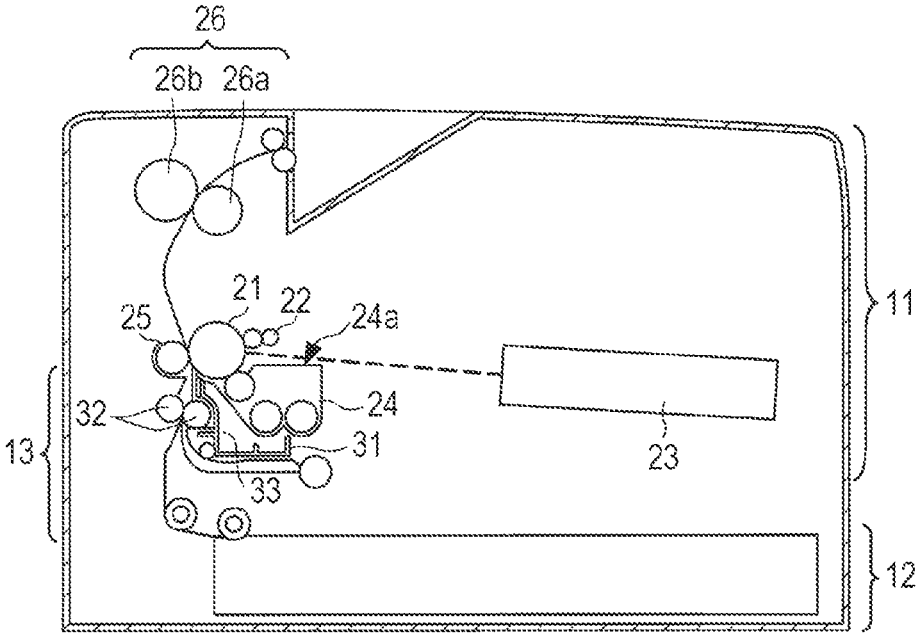
FIG. 2 illustrates structures of an image forming section, a paper feed unit, and a transport unit.

FIG. 1 is a perspective view of an image forming apparatus 1 according to an exemplary embodiment. The image forming apparatus 1 includes, in a housing 10, an image forming section 11, a paper feed unit 12, a transport unit 13, and a board unit 14. FIG. 2 illustrates structures of the image forming section 11, the paper feed unit 12, and the transport unit 13. The image forming section 11 forms an image on a medium, such as a sheet of paper, by electrophotography. The image forming section 11 includes a photoconductor drum 21, a charger 22, an exposure unit 23, a developing unit 24 (an example of a developing unit or a detected portion), a transfer roller 25, and a fixing unit 26. The charger 22, the exposure unit 23, the developing unit 24, the transfer roller 25, and the fixing unit 26 perform a charging process, an exposure process, a developing process, a transfer process, and a fixing process, respectively.

The photoconductor drum 21 is a cylindrical image carrier that rotates about its axis. A photoconductive film is provided on a surface of the photoconductor drum 21. The charger 22 charges the surface of the photoconductor drum 21 to a predetermined potential through the application of a charging bias voltage. The exposure unit 23 exposes the charged photoconductor drum 21 according to image signals to form an electrostatic latent image. The developing unit 24 develops the electrostatic latent image on the photoconductor drum 21 with toner to form a toner image. The transfer roller 25 transfers the toner image on the photoconductor drum 21 onto a medium through the application of a transfer bias voltage. The fixing unit 26 applies, from a fixing roller 26*a* and a pressurizing roller 26*b*, heat and pressure to the medium on which the toner image is transferred and thereby fixes the toner image on the medium. After passing through the fixing unit 26, the medium is output from the image forming apparatus 1.

The paper feed unit 12 contains plural media, and feeds out the media one by one. The transport unit 13 includes a sheet transport member 31 (an example of a guide member) and transport rollers 32. The sheet transport member 31 guides a medium output from the paper feed unit 12 to the transport rollers 32. The transport rollers 32 transport the medium guided by the sheet transport member 31 to the transfer roller 25. A cylindrical or substantially cylindrical duct 33 is provided between a casing 24*a* of the developing unit 24 and the sheet transport member 31. The duct 33 has opposite open ends, and allows the passage of air therethrough. One end of the duct 33 serves as an entrance 33*a* from which air flows in, and the other end of the duct 33 serves as an exit 33*b* from which air flows out. Since the duct 33 is adjacent to the developing unit 24, air flowing through the duct 33 is influenced by the temperature and humidity of the developing unit 24.

Figure 3:
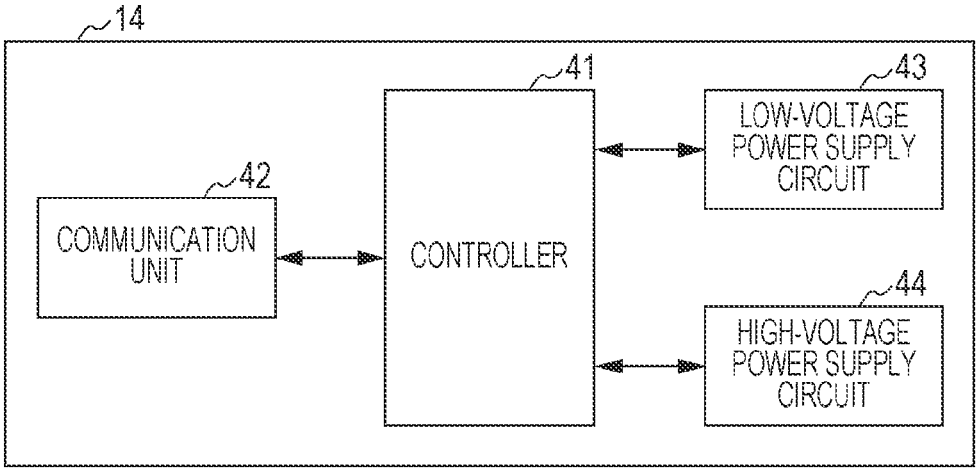
FIG. 3 illustrates a configuration of a board unit.

FIG. 3 illustrates a configuration of the board unit 14. The board unit 14 includes a controller 41, a communication unit 42, a low-voltage power supply circuit 43, and a high-voltage power supply circuit 44 (an example of a power supply circuit). For example, the controller 41 includes a central processing unit (CPU) and a memory. The CPU executes a program stored in the memory to control the units in the image forming apparatus 1. The communication unit 42 is connected to a communication line, and communicates with an unillustrated client apparatus via the communication line. When the communication unit 42 receives image data from the client apparatus, the controller 41 supplies image signals based on the received image data to the exposure unit 23. To the low-voltage power supply circuit 43 and the high-voltage power supply circuit 44, power is supplied from a commercial power supply. The low-voltage power supply circuit 43 applies a voltage to the units in the image forming apparatus 1 under the control of the controller 41. The high-voltage power supply circuit 44 applies a voltage higher than that of the low-voltage power supply circuit 43 to predetermined portions of the image forming apparatus 1. The predetermined portions are, for example, the charger 22, the developing unit 24, the transfer roller 25, and the fixing unit 26.

Figure 4:
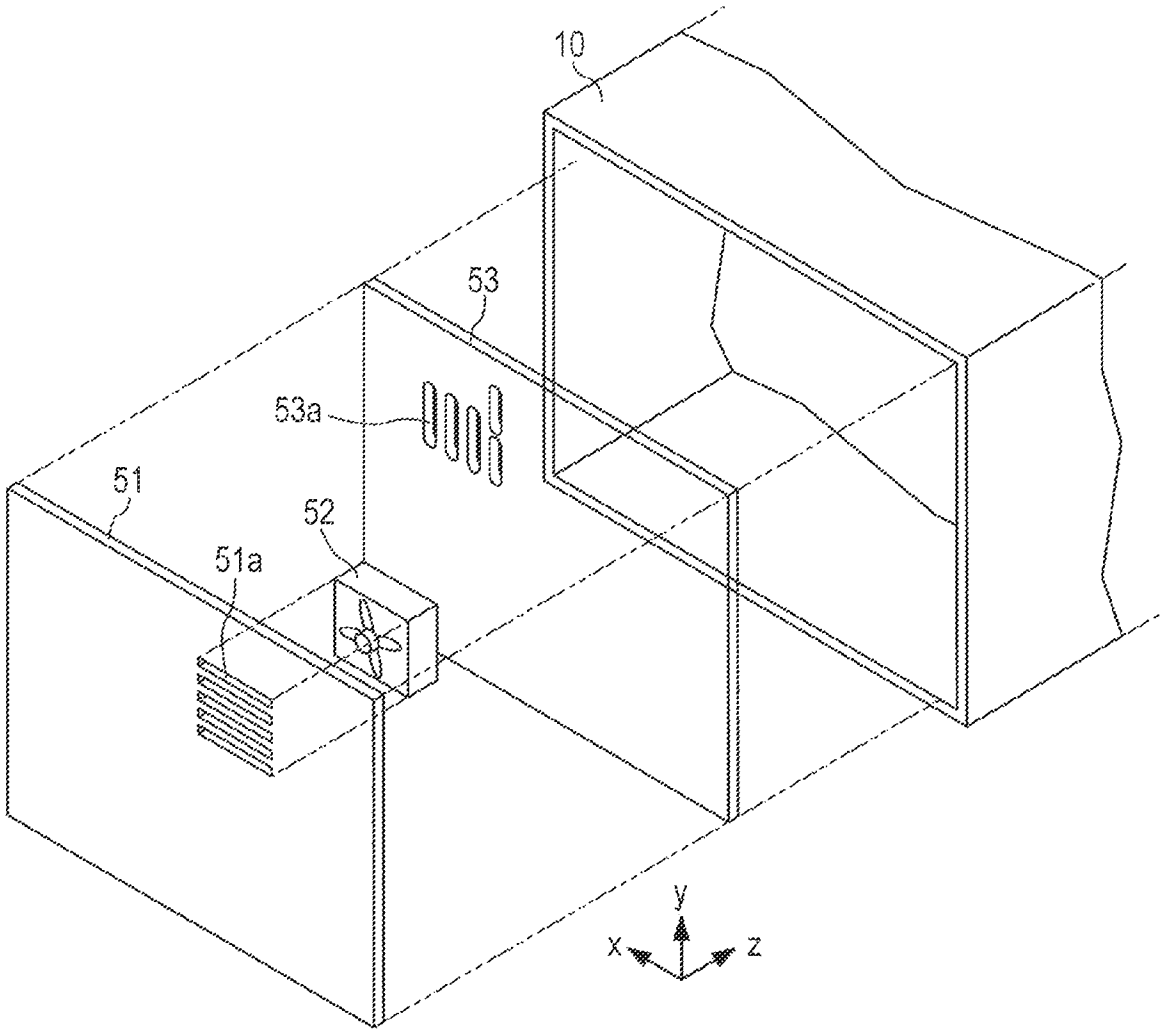
FIG. 4 is an exploded perspective view of a left side of a housing.

FIG. 4 is an exploded perspective view of a left side of the housing 10. On the left side of the housing 10, a first side cover 51 is provided. The first side cover 51 has a first air inlet 51*a*, and a suction fan 52 (an example of a suction unit) is provided at the first air inlet 51*a*. When driven, the suction fan 52 sucks air from the outside of the housing 10 via the first air inlet 51*a*. On an inner side of the first side cover 51, a first frame 53 is provided to support the image forming section 11 in the z-axis direction. The first frame 53 has plural air holes 53*a* through which air flows. While the first frame 53 has holes and irregularities for supporting the image forming section 11 in actuality, structures thereof are not illustrated in FIG. 4. Further, a low-voltage power supply board on which the low-voltage power supply circuit 43 is mounted may be provided between the first side cover 51 and the first frame 53.

Figure 5:
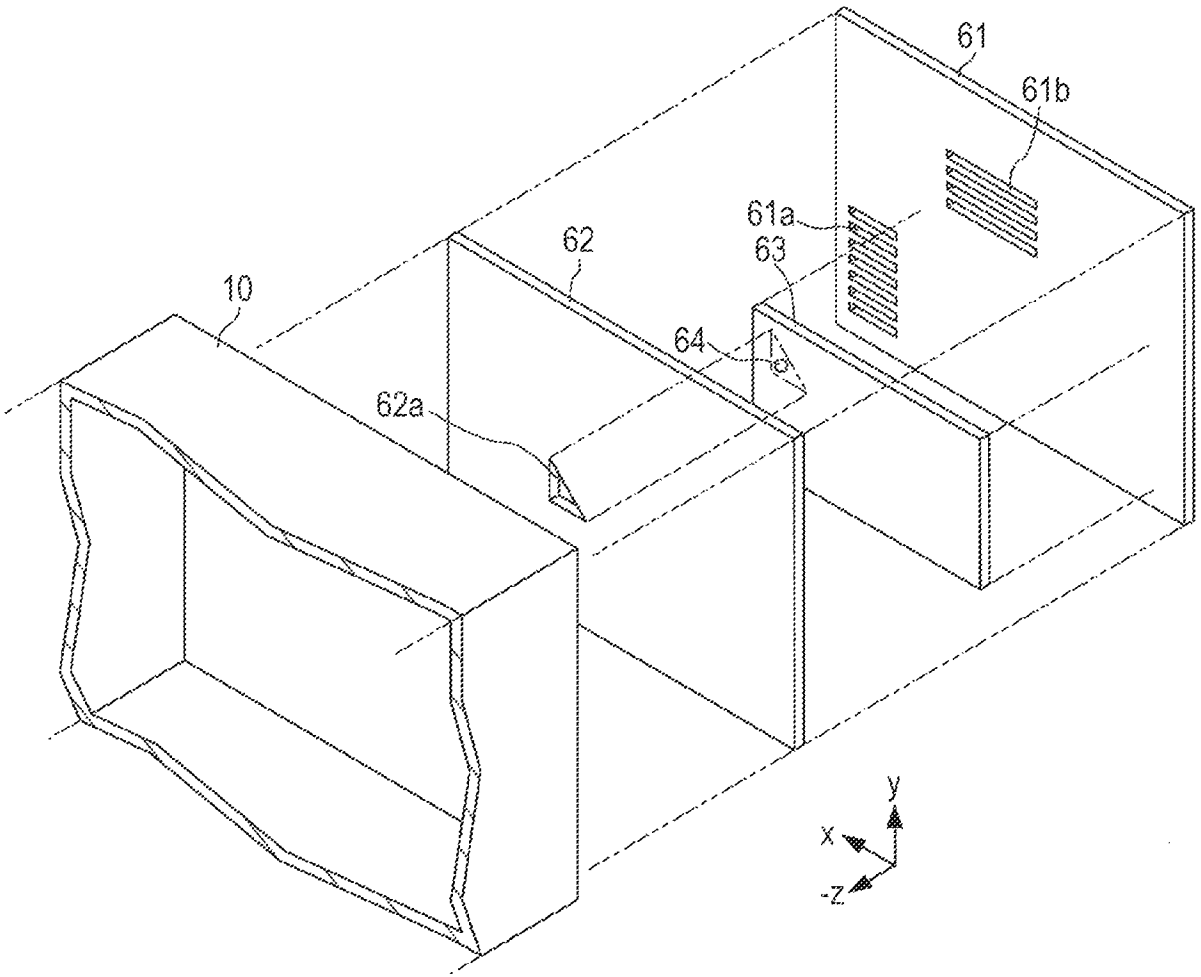
FIG. 5 is an exploded perspective view of a right side of the housing.

FIG. 5 is an exploded perspective view of a right side of the housing 10. On the right side of the housing 10, a second side cover 61 is provided. The second side cover 61 has a second air inlet 61*a* and an air outlet 61*b*. On an inner side of the second side cover 61, a second frame 62 is provided to support the image forming section 11 in the -z-direction. An ejection hole 62*a* is provided at a position in the second frame 62 opposing the exit 33*b* of the duct 33. While the second frame 62 has holes and irregularities for supporting the image forming section 11 in actuality, structures thereof are not illustrated in FIG. 5. A high-voltage power supply board 63 (an example of a board) on which the high-voltage power supply circuit 44 is mounted is provided between the second side cover 61 and the second frame 62. On the high-voltage power supply board 63, an environment sensor 64 (an example of a detection unit) is provided at a position opposing the ejection hole 62*a* between the second air inlet 61*a* and the air outlet 61*b*. For example, the environment sensor 64 includes a thermistor sensor and a humidity sensor. The environment sensor 64 detects the temperature and humidity, and outputs signals based on the detected temperature and humidity.

2. Operation

Figure 6:
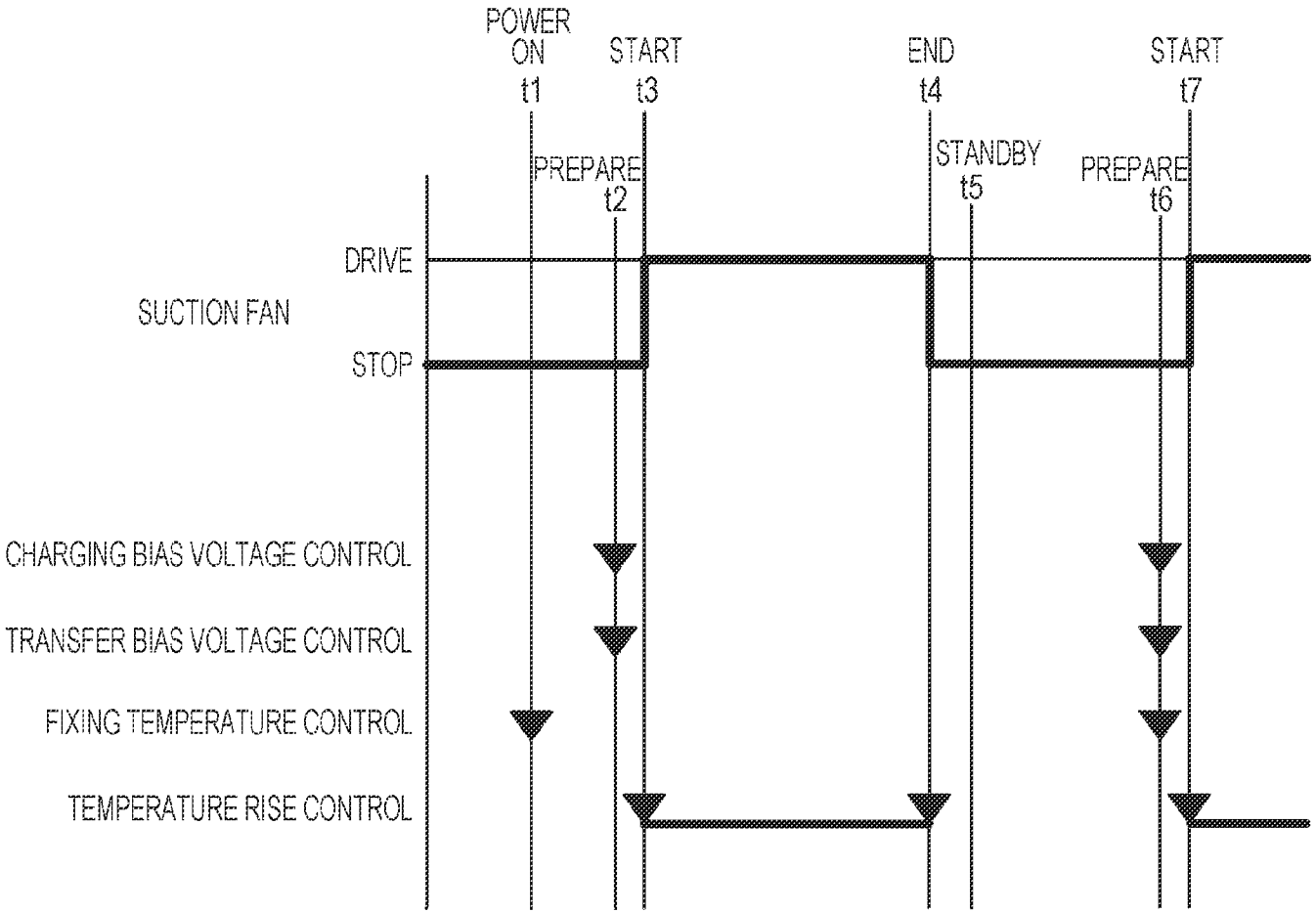
FIG. 6 is a timing chart of control operation of a controller.

FIG. 6 is a timing chart of control operation performed by the controller 41. When the image forming apparatus 1 is powered on at a time t1, the controller 41 performs fixing temperature control. At this time, the controller 41 measures the temperature and humidity of outside air with the environment sensor 64. Here, the term "outside air" refers to air taken in through the second air inlet 61*a*.

Figure 7A:
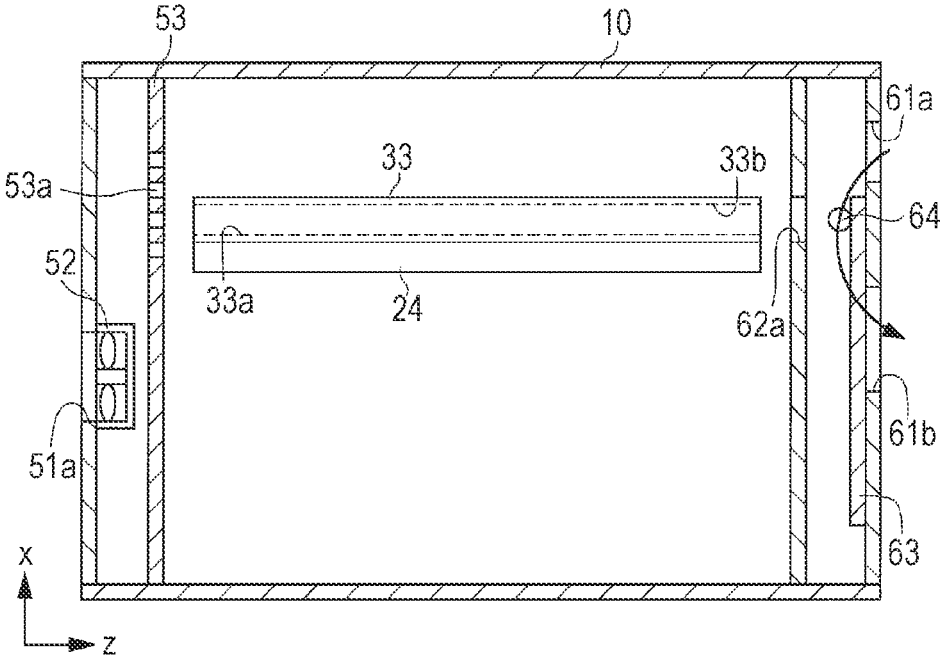
FIGS. 7A and 7B illustrate a mechanism for measuring the temperature and humidity.
Figure 7B:
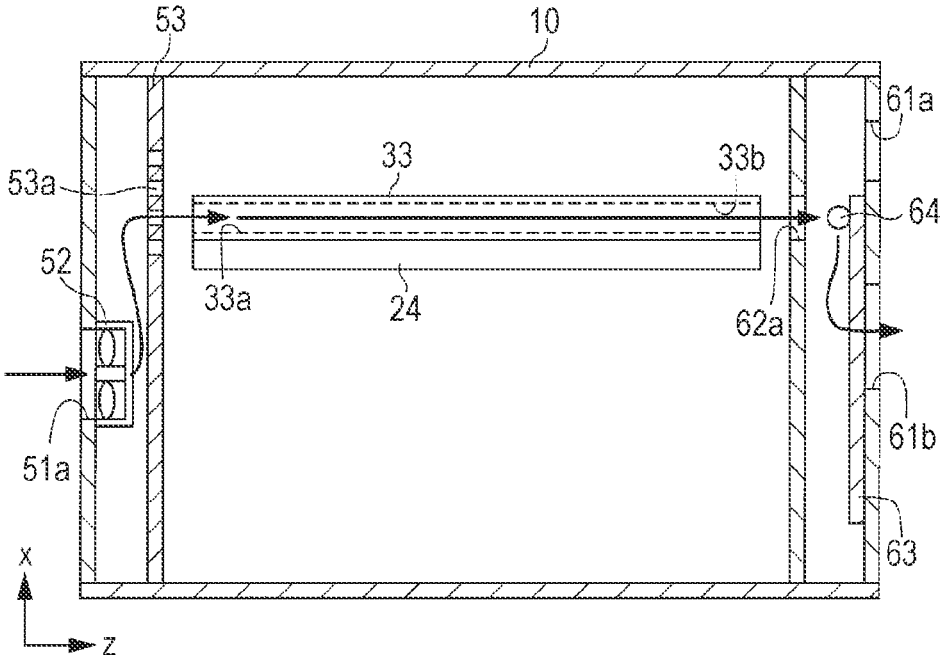

FIGS. 7A and 7B illustrate a mechanism for measuring the temperature and humidity. In FIGS. 7A and 7B, the structures other than the developing unit 24 in the image forming section 11 are not illustrated. At the time t1, the suction fan 52 is not driven. In this case, as illustrated in FIG. 7A, air flows from the outside into the inside through the second air inlet 61*a*. The air is exhausted from the air outlet 61*b* via the environment sensor 64. At this time, the environment sensor 64 detects the temperature and humidity of the air flowing in through the second air inlet 61*a*, and outputs signals based on the detected temperature and humidity. On the basis of the signals output from the environment sensor 64, the controller 41 measures the temperature and humidity of the outside air. After measuring the temperature and humidity of the outside air, the controller 41 determines a fixing temperature suitable for the measured temperature and humidity. Then, the controller 41 controls the high-voltage power supply circuit 44 to apply a voltage based on the determined fixing temperature to the fixing roller 26*a*.

When the communication unit 42 receives image data from the client apparatus, the controller 41 prepares to form an image at a time t2. In this preparation, the controller 41 performs charging bias voltage control and transfer bias voltage control. At this time, the controller 41 measures the temperature and humidity of outside air with the environment sensor 64 in a method similar to the above-described method. After measuring the temperature and humidity of the outside air, the controller 41 determines a charging bias voltage suitable for the measured temperature or humidity. Then, the controller 41 controls the high-voltage power supply circuit 44 to apply the determined charging bias voltage to the charger 22. Further, the controller 41 determines a transfer bias voltage suitable for the measured temperature or humidity. Then, the controller 41 controls the high-voltage power supply circuit 44 to apply the determined transfer bias voltage to the transfer roller 25.

When the image forming section 11 starts image formation at a time t3, the controller 41 performs temperature rise control. At this time, the controller 41 drives the suction fan 52 and measures the temperature and humidity of the developing unit 24 with the environment sensor 64. When the suction fan 52 is driven, as illustrated in FIG. 7B, outside air is sucked by the suction fan 52 through the first air inlet 51*a*. The air sucked by the suction fan 52 is guided to the entrance 33*a* of the duct 33 via the air holes 53*a* of the first frame 53. The air flowing in through the entrance 33*a* of the duct 33 passes through the duct 33. The air passing through the duct 33 cools the developing unit 24, and also is heated by heat generated by the developing unit 24. After passing through the duct 33, the air flows out from the exit 33*b* of the duct 33, and is blown onto the environment sensor 64 via the ejection hole 62*a*.

At this time, the environment sensor 64 detects the temperature and humidity of the air that has passed through the duct 33, and outputs signals based on the detected temperature and humidity. On the basis of the signals output from the environment sensor 64, the controller 41 measures the temperature and humidity of the developing unit 24. Here, the environment sensor 64 detects the temperature of the air that has passed through the duct 33 adjacent to the developing unit 24. Since the air that has passed through the duct 33 is influenced by the temperature of the developing unit 24, the temperature measured with the environment sensor 64 correlates to the temperature of the developing unit 24. Accordingly, the controller 41 measures the temperature of the developing unit 24 with reference to a correlation table T prestored in the memory.

Figures 8, 9:
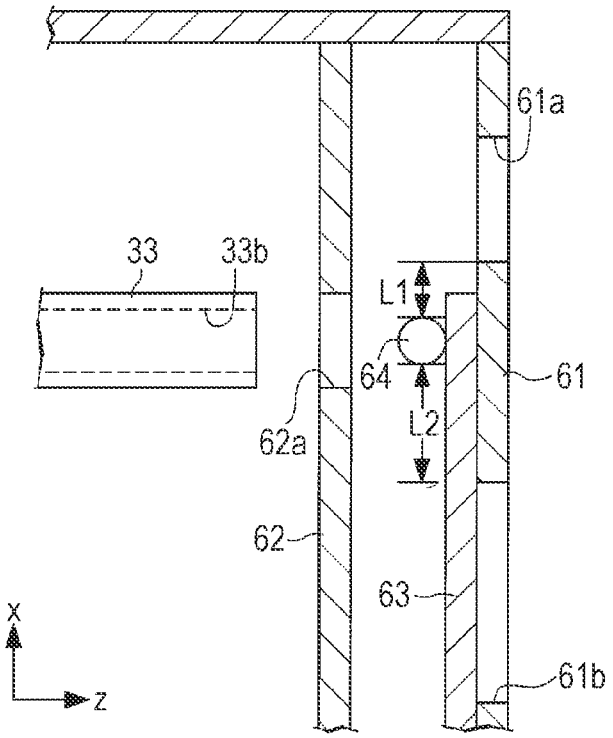
FIG. 8 is an example of a correlation table.
FIG. 9 illustrates a position of an environment sensor in a modification.

FIG. 8 is an example of a correlation table T. In the correlation table T, temperatures of the developing unit 24 and measured temperatures are stored in correlation. In the correlation table T, a temperature of "53° C." of the developing unit 24 and a measured temperature of "33° C." are stored in correlation. This means that the temperature measured with the environment sensor 64 is 33° C. when the temperature of the developing unit 24 is 53° C. Therefore, for example, when the temperature measured with the environment sensor 64 is 33° C., the temperature of the developing unit 24 is 53° C.

After measuring the temperature of the developing unit 24, the controller 41 determines whether or not the measured temperature is less than a threshold value. For example, it is assumed that the threshold value of the temperature of the developing unit 24 is 55° C. In the correlation table, a temperature of "55° C." of the developing unit 24 is stored in correlation with a measured temperature of "35° C.". In this case, the threshold value of the measured temperature is 35° C. Therefore, the controller 41 determines whether or not the measured temperature is less than 35° C. When the measured temperature is less than the threshold value, the controller 41 performs normal control. In contrast, when the measured temperature is more than or equal to the threshold value, the controller 41 decreases the temperature in the apparatus by temporarily stopping image formation of the image forming section 11 or reducing the image forming speed. For example, to reduce the image forming speed, the controller 41 rotates the photoconductor drum 21 at low speed.

When image formation of the image forming section 11 is finished at a time t4, the controller 41 stops the suction fan 52. That is, in the image forming section 11, the suction fan 52 is driven during an image forming period from the time t3 to the time t4. At a time t5, the image forming apparatus 1 shifts to a standby state. When the communication unit 42 receives image data from the client apparatus again, the controller 41 prepares to form an image at a time t6. At this time, the controller 41 performs the fixing temperature control, the charging bias voltage control, and the transfer bias voltage control described above. When the image forming section 11 starts image formation at a time t7, the controller 41 performs the above-described temperature rise control until the image formation is finished.

According to the exemplary embodiment, the single environment sensor 64 measures both the outside environment of the housing 10 and the environment of the developing unit 24. The term "environment" refers to temperature or humidity. Further, since the environment sensor 64 is provided between the second air inlet 61*a* and the air outlet 61*b*, outside air is unlikely to touch the environment sensor 64 while the suction fan 52 is driven. Therefore, the temperature and humidity of the developing unit 24 may be detected accurately. Further, the use of the correlation table T may allow the temperature and humidity of the developing unit 24 to be accurately measured even when the environment sensor 64 is provided at a position apart from the developing unit 24.

Since the environment sensor 64 is provided on the high-voltage power supply board 63 in the above-described exemplary embodiment, it does not need to have a separate harness. This may reduce the number of components of the image forming apparatus 1. Further, since the duct 33 is provided between the casing 24*a* of the developing unit 24 and the sheet transport member 31, the size of the image forming apparatus 1 may be reduced, compared with a case in which the duct 33 is formed by an independent member.

In addition, in the above-described exemplary embodiment, the suction fan 52 is driven during the image forming period, but is stopped in other periods. Therefore, the temperature and humidity of the developing unit 24 are detected during the image forming period, and the temperature and humidity of air outside of the housing 10 are detected in the other periods. Further, since the temperature rise control is performed during the image forming period, the temperature in the image forming apparatus 1 may be prevented from rising excessively. This temperature rise control may also prevent toner contained in the developing unit 24 from blocking (fusion of toner particles).

3. Modifications

The above-described exemplary embodiment is just exemplary of the present invention. The present invention is not limited to the above-described exemplary embodiment, and may be modified as follows. The following modifications may be combined.

(1) First Modification

The position of the environment sensor 64 is not limited to the position adopted in the exemplary embodiment. The environment sensor 64 may be provided at any position as long as the position is on a path of air flowing in from the second air inlet 61*a* and on a path of air that has passed through the duct 33. For example, the position on the path of the air is a position that touches the air. For example, the position on the path of air flowing in from the second air inlet 61*a* may be a position where the temperature of outside air and the temperature less than the threshold value can be measured. Further, the position on the path of air that has passed through the duct 33 may be a position opposing the exit 33*b* of the duct 33.

The environment sensor 64 may be provided near the second air inlet 61*a* on the high-voltage power supply board 63. FIG. 9 illustrates the position of an environment sensor 64 according to the first modification. The environment sensor 64 is provided at a position such that a distance L1 between the environment sensor 64 and the second air inlet 61*a* is shorter than a distance L2 between the environment sensor 64 and the air outlet 61*b*. In this case, air flowing in from the second air inlet 61*a* touches the environment sensor 64 before being heated in the image forming apparatus 1. This may allow the temperature of outside air to be measured accurately.

(2) Second Modification

Figure 10:
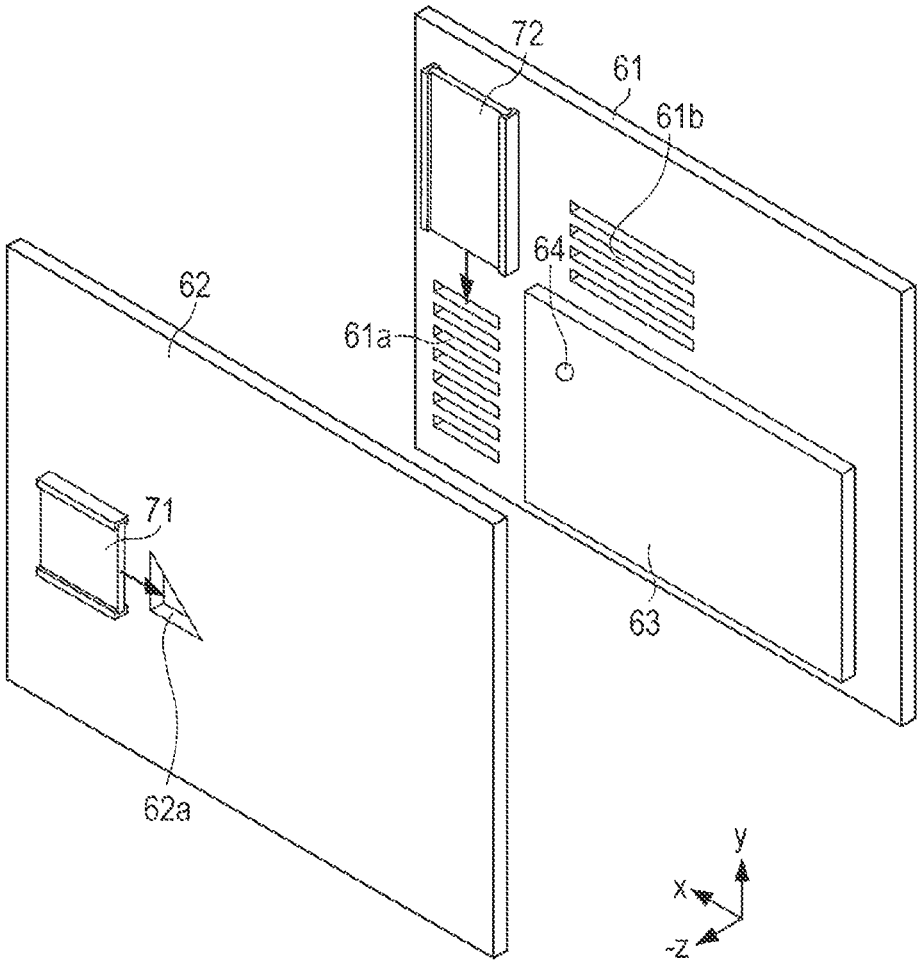
FIG. 10 illustrates a first shutter and a second shutter in another modification.

The ejection hole 62*a* and the second air inlet 61*a* may be provided with a first shutter 71 and a second shutter 72, respectively, as illustrated in FIG. 10. While the first shutter 71 and the second shutter 72 are provided on inner surfaces of the second frame 62 and the second side cover 61, respectively, in FIG. 10, they may be provided on outer surfaces of the second frame 62 and the second side cover 61. The first shutter 71 opens and closes the ejection hole 62*a* under the control of the controller 41, and the second shutter 72 opens and closes the second air inlet 61*a* under the control of the controller 41. While the first shutter 71 is provided at the ejection hole 62*a* in FIG. 10, it may be provided at the exit 33*b* of the duct 33.

During periods other than an image forming period, the controller 41 opens the second shutter 72 to open the second air inlet 61*a* and closes the first shutter 71 to close the ejection hole 62*a*. Since the ejection hole 62*a* is provided at the position opposing the exit 33*b* of the duct 33, closing the ejection hole 62*a* indirectly closes the exit 33*b* of the duct 33. In this case, air that has passed through the duct 33 does not touch the environment sensor 64 while the temperature and humidity of outside air are being measured. Hence, the accuracy in measuring the temperature and humidity of outside air may increase. During the image forming period, the controller 41 opens the first shutter 71 to open the ejection hole 62*a* and closes the second shutter 72 to close the second air inlet 61*a*. In this case, air flowing in from the second air inlet 61*a* does not touch the environment sensor 64 while the temperature and humidity of the developing unit 24 are being measured. Hence, the accuracy in detecting the temperature and humidity of the developing unit 24 may increase. That is, according to the second modification, both the environment of outside air and the environment of the developing unit 24 may be detected accurately.

(3) Third Modification

Figure 11:
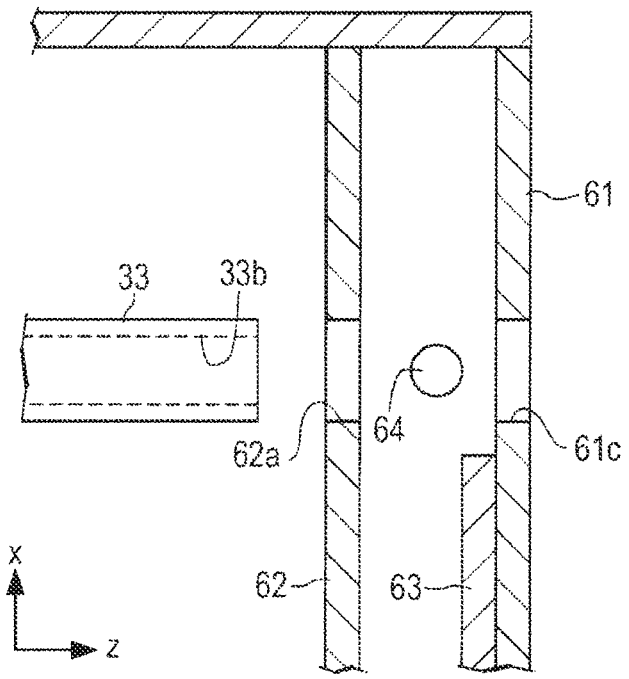
FIG. 11 illustrates a position of an environment sensor in a further modification.

The second side cover 61 may have only one opening 61*c*, instead of the second air inlet 61*a* and the air outlet 61*b*. FIG. 11 illustrates the position of an environment sensor 64 according to a third modification. The second side cover 61 has the opening 61*c* provided at a position opposing the ejection hole 62*a*. The environment sensor 64 is provided between the ejection hole 62*a* and the opening 61*c* while being supported by an unillustrated support portion. In this structure, the single environment sensor 64 also measures both the environment of outside air and the environment of the developing unit 24, similarly to the above-described exemplary embodiment.

(4) Fourth Modification

The members that define the duct 33 are not limited to the casing 24*a* of the developing unit 24 and the sheet transport member 31. For example, the duct 33 may be independently formed by a cylindrical member. In this case, the duct 33 does not always need to directly adjoin the developing unit 24. It is satisfactory as long as the duct 33 is provided at a position influenced by the temperature and humidity of the developing unit 24. Further, the shape of the duct 33 is not limited to the shape of FIG. 2. For example, the duct 33 may be shaped like a cylinder of circular, elliptic, rectangular, or polygonal cross section.

(5) Fifth Modification

The environment sensor 64 may be provided on a member different from the high-voltage power supply board 63. For example, the environment sensor 64 may be provided on the low-voltage power supply board on which the low-voltage power supply circuit 43 is mounted or on a control board on which the controller 41 is mounted. Alternatively, the environment sensor 64 may be directly provided on the inner surface of the second side cover 61.

(6) Sixth Modification

The time at which the suction fan 52 is driven is not limited to the start point of image formation. For example, even when image formation is not performed, the suction fan 52 may be driven and the temperature and humidity of the developing unit 24 may be measured, as required.

(7) Seventh Modification

The environment sensor 64 is not limited to the sensor that detects both temperature and humidity. For example, the environment sensor 64 may detect only temperature with only the thermistor sensor. Alternatively, the environment sensor 64 may detect only humidity with only the humidity sensor. Further, the humidity may be measured with reference to a correlation table that shows correlation between the humidity of the developing unit 24 and the measured humidity, similarly to the above-described measurement of temperature.

(8) Eighth Modification

The object to be detected by the environment sensor 64 is not limited to the developing unit 24. For example, the environment sensor 64 may detect the temperature and humidity of the exposure unit 23, the fixing unit 26, the low-voltage power supply board on which the low-voltage power supply circuit 43 is mounted, or the control board on which the controller 41 is mounted. In this case, for example, the duct 33 is provided adjacent to a portion to be detected by the environment sensor 64. However, the duct 33 does not always need to be provided adjacent to the portion to be detected. It is satisfactory as long as the duct 33 is provided at a position influenced by the temperature or humidity of the portion to be detected.

(9) Ninth Modification

The program to be executed by the CPU in the controller 41 may be provided in a state recorded on a recording medium such as a magnetic tape, a magnetic disk, a flexible disk, an optical disk, a magnetooptical disk, or a memory, and may be installed in the image forming apparatus 1. Alternatively, the program may be downloaded in the image forming apparatus 1 via a communication line such as the internet.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

a housing;

a detection unit provided in the housing to detect temperature or humidity;

an image forming section provided in the housing to form an image, and including a detected portion to be detected by the detection unit;

a first air inlet provided in the housing;

a suction unit that sucks air outside of the housing through the first air inlet;

a duct provided at a position influenced by temperature or humidity of the detected portion and including an entrance from which air flows in and an exit from which air flows out, the duct allowing the air sucked by the suction unit to pass therethrough; and a second air inlet and an air outlet provided in the housing, wherein the detection unit is provided at a position on a first path of air flowing into the housing through the second air inlet and on a second path of the air that has passed through the duct, wherein air flowing in through the second air inlet and the air that has passed through the duct are exhausted from the air outlet, wherein the detection unit is provided between the second air inlet and the air outlet, and wherein the second air inlet and the air outlet are both provided at an exit side of the duct.

2. The image forming apparatus according to claim 1, wherein the detection unit is provided at a position such that a distance between the detection unit and the second air inlet is shorter than a distance between the detection unit and the air outlet.

3. The image forming apparatus according to claim 1, further comprising:

a first shutter that opens and closes the exit of the duct;

a second shutter that opens and closes the second air inlet; and a controller that controls the first shutter and the second shutter, the controller opening the second shutter to open the second air inlet and closing the first shutter to close the exit when temperature or humidity of the air outside of the housing is detected, and opening the first shutter to open the exit and closing the second shutter to close the second air inlet when temperature or humidity of the detected portion is detected.

4. The image forming apparatus according to claim 1, wherein the detection unit is provided on a board on which a power supply circuit that applies voltage to the image forming section is mounted.

5. The image forming apparatus according to claim 1, wherein the image forming section forms the image by electrophotography, wherein the detected portion is a developing unit that performs a developing process, and wherein the duct is formed by a casing that contains the developing unit and a guide member that guides a medium supplied from a paper feed unit to the image forming section.

6. The image forming apparatus according to claim 1, further comprising:

a controller that controls the suction unit to drive the suction unit when image formation is started by the image forming section and to stop the suction unit when the image formation is finished.

7. The image forming apparatus according to claim 6, wherein the controller stops the image formation of the image forming section or reduces a speed of the image formation when the temperature detected by the detection unit is more than or equal to a threshold value.

8. The image forming apparatus according to claim 1, wherein the second air inlet and the air outlet are both provided at a side of the housing opposite to a side at which the first air inlet is provided.

9. The image forming apparatus according to claim 1, wherein the image forming apparatus is configured such that, whenever the suction unit is sucking air outside of the housing through the first air inlet, air flowing into the housing through the second air inlet does not touch the detection unit.

10. The image forming apparatus according to claim 9, wherein the image forming apparatus is configured such that, whenever the suction unit is not sucking any air outside of the housing through the first air inlet, air flowing into the housing through the second air inlet touches the detection unit.

11. The image forming apparatus according to claim 1, wherein the suction unit is configured such that the suction unit does not suck any air flowing through the second air inlet.

12. An image forming apparatus comprising:

a housing;

a detection unit provided in the housing to detect temperature or humidity;

an image forming section provided in the housing to form an image, and including a detected portion to be detected by the detection unit;

a first air inlet provided in the housing;

a suction unit that sucks air outside of the housing through the first air inlet;

a duct provided at a position influenced by temperature or humidity of the detected portion and including an entrance from which air flows in and an exit from which air flows out, the duct allowing the air sucked by the suction unit to pass therethrough; and a second air inlet and an air outlet provided in the housing, wherein the detection unit is provided at a position on a path of air flowing into the housing through the second air inlet and on a path of the air that has passed through the duct, wherein air flowing in through the second air inlet and the air that has passed through the duct are exhausted from the air outlet, wherein the detection unit is provided between the second air inlet and the air outlet, and wherein the detection unit is provided at a position such that a distance between the detection unit and the second air inlet is shorter than a distance between the detection unit and the air outlet.

13. An image forming apparatus comprising:

a housing;

a detection unit provided in the housing to detect temperature or humidity;

an image forming section provided in the housing to form an image, and including a detected portion to be detected by the detection unit;

a first air inlet provided in the housing;

a suction unit that sucks air outside of the housing through the first air inlet;

a duct provided at a position influenced by temperature or humidity of the detected portion and including an entrance from which air flows in and an exit from which air flows out, the duct allowing the air sucked by the suction unit to pass therethrough; and a second air inlet and an air outlet provided in the housing, wherein the detection unit is provided at a position on a path of air flowing into the housing through the second air inlet and on a path of the air that has passed through the duct, wherein air flowing in through the second air inlet and the air that has passed through the duct are exhausted from the air outlet, wherein the detection unit is provided between the second air inlet and the air outlet, and wherein the image forming apparatus further comprises:

a first shutter that opens and closes the exit of the duct;

a second shutter that opens and closes the second air inlet; and a controller that controls the first shutter and the second shutter, the controller opening the second shutter to open the second air inlet and closing the first shutter to close the exit when temperature or humidity of the air outside of the housing is detected, and opening the first shutter to open the exit and closing the second shutter to close the second air inlet when temperature or humidity of the detected portion is detected.

14. An image forming apparatus comprising:

a housing;

a detection unit provided in the housing to detect temperature or humidity;

an image forming section provided in the housing to form an image, and including a detected portion to be detected by the detection unit;

a first air inlet provided in the housing;

a suction unit that sucks air outside of the housing through the first air inlet;

a duct provided at a position influenced by temperature or humidity of the detected portion and including an entrance from which air flows in and an exit from which air flows out, the duct allowing the air sucked by the suction unit to pass therethrough; and an opening provided in the housing, wherein the detection unit is provided at a position on a path of air flowing into the housing through the opening and on a path of the air that has passed through the duct, wherein the image forming section forms the image by electrophotography, wherein the detected portion is a developing unit that performs a developing process, and wherein the duct is formed by a casing that contains the developing unit and a guide member that guides a medium supplied from a paper feed unit to the image forming section.

* * * * *